US006439078B1

(12) United States Patent
Schlude et al.

(10) Patent No.: US 6,439,078 B1
(45) Date of Patent: Aug. 27, 2002

(54) OVERLOAD PROTECTION DEVICE FOR A LEVER

(75) Inventors: Richard D. Schlude; Daniel L. DeMarco, both of York, PA (US)

(73) Assignee: FKI Industries Inc., Fairfield, CT (US)

( * ) Notice: Subject to any disclaimer, the term of this patent is extended or adjusted under 35 U.S.C. 154(b) by 74 days.

(21) Appl. No.: 09/658,871

(22) Filed: Sep. 8, 2000

(51) Int. Cl.[7] ..... G05G 5/06

(52) U.S. Cl. ..... 74/527; 74/528; 74/545; 464/32; 464/34; 464/38; 254/352

(58) Field of Search ..... 254/352; 464/32–38; 74/545, 527, 528; 403/370

(56) References Cited

U.S. PATENT DOCUMENTS

| | | | | | |
|---|---|---|---|---|---|
| 1,078,107 | A | | 11/1913 | Ngren | |
| 1,179,948 | A | | 4/1916 | Malcolm | |
| 1,667,864 | A | | 5/1928 | Maley | |
| 2,026,350 | A | | 12/1935 | Looschen | |
| 2,165,984 | A | | 7/1939 | Schroeder | |
| 2,243,361 | A | | 5/1941 | Stahl | |
| 2,894,610 | A | | 7/1959 | Harrington | |
| 3,100,031 | A | | 8/1963 | Lock | |
| 3,282,387 | A | * | 11/1966 | Becker et al. | 192/150 |
| 3,379,034 | A | * | 4/1968 | Gustafson | 64/29 |
| 3,546,897 | A | * | 12/1970 | Kenny | 64/29 |
| 3,751,941 | A | * | 8/1973 | Stiff | 64/30 E |
| 3,831,401 | A | * | 8/1974 | Hurwitz | 64/30 R |
| 3,893,553 | A | * | 7/1975 | Hansen | 192/56 R |
| 4,174,621 | A | * | 11/1979 | Woltjen | 64/29 |
| 4,255,946 | A | * | 3/1981 | Hansen | 64/29 |
| 4,325,470 | A | | 4/1982 | Bopp | |
| 4,427,399 | A | * | 1/1984 | Rudolp et al. | 464/38 |
| 4,463,933 | A | * | 8/1984 | Schreyer et al. | 254/368 |
| 4,606,443 | A | * | 8/1986 | Kimura | 192/20 |
| 4,768,754 | A | | 9/1988 | Nishimura | |
| 5,411,122 | A | * | 5/1995 | Uphaus | 192/66 |
| 5,791,579 | A | | 8/1998 | Raphael et al. | |
| 5,816,614 | A | | 10/1998 | Kramer, Jr. et al. | |
| 5,865,561 | A | * | 2/1999 | Muellenberg | 403/370 |

FOREIGN PATENT DOCUMENTS

| | | | | |
|---|---|---|---|---|
| FR | 2649031 | * | 1/1991 | 464/38 |

OTHER PUBLICATIONS

Product Catalog for Acco Chain & Lifting Products Division, 1999.

* cited by examiner

*Primary Examiner*—Vinh T. Luong
(74) *Attorney, Agent, or Firm*—Nixon Peabody LLP; Charles M. Leedom, Jr.; Daniel S. Song

(57) ABSTRACT

An overload protection device for a manual hoist lever including a pressure hub, an outer hub, a brake nut, and a dowel pin. The pressure hub includes a radially extending flange and a cantilevered boss having a threaded outer surface with an axial groove. The outer hub includes a central opening, a tapered inner surface, and a flange contact surface which frictionally contacts the radially extending flange of the pressure hub. The brake nut is disposed in the central opening of the outer hub between the outer hub and the boss of the pressure hub, and includes a frusto-conical outer surface that frictionally contacts the tapered inner surface of the outer hub, as well as a threaded inner opening with a corresponding axial groove, the threaded inner opening being sized to threadingly engage the boss. The dowel pin is received within a receiving hole formed upon alignment of the axial groove of the boss and the corresponding axial groove of the brake nut. The outer hub preferably includes a plurality of ratchet gear teeth and the frictional resistance of the overload protection device adjustable by tightening or loosening the brake nut.

23 Claims, 2 Drawing Sheets

OVERLOAD PROTECTION DEVICE FOR A LEVER

BACKGROUND OF THE INVENTION

1. Field of the Invention

The present invention is related to the field of manual lever hoists. More specifically, the invention relates to overload protection devices for levers which limit the amount of torque which can be applied to the hoist.

2. Description of Related Art

Various manual lever hoists have been generally known in the art and are commonly used to apply or release tension to a chain or a cable. For instance, such manual lever hoists are commonly used in industry to tighten cables, lift objects as well as various other material handling purposes. Examples of manual lever hoists used in lifting applications are generally shown and taught in various prior art documents such as U.S. Pat. No. 4,325,470 to Bopp, U.S. Pat. No. 4,768,754 to Nishimura, and U.S. Pat. No. 5,791,579 to Raphael et al. These manual lever hoists include a hoist and a lever attached thereto for operating the hoist. The hoist typically engages a chain (or a cable) and are operable to displace the chain so as to lift or lower an object removably attached thereto. In this regard, the manual levers used in conjunction with these hoists generally have a ratchet assembly. The hoists can be manually operated via the ratchet assembly to displace the chain so that lifting or lowering of objects can be attained by repeatedly pivoting the lever. The length of the lever provides mechanical leverage to exert high torque on the hoist so that heavy objects can be lifted.

Some models of levers also have a ratchet assembly with an overload protection device that essentially act as a clutch so that only a predetermined amount of torque may be applied to the hoist via the lever. Such an overload device feature is important in many applications of the manual lever hoists because it prevents the overloading of the hoist, chain, and/or any other component such as the hook attached to the chain or the structure supporting the hoist. If the hoist, chain and/or other components are overloaded such as in a case where the object being lifted weighs more than the rated capacity of the hoist, chain and/or other component, there is a danger of one or more of the components failing and thus, damaging the hoist. Such failure of a component can cause the object being lifted to be dropped and damaged as well. More importantly, the falling object can also cause great bodily injury or even death to anyone in the object's path.

U.S. Pat. No. 4,325,470 to Bopp discloses an overload clutch having a plurality of first clutch disks which frictionally engage a plurality of second clutch disks to thereby transmit torque from the lever to the hoist. The overload clutch is preloaded to a torque capacity corresponding to the rated load of the hoist such that the clutch disks will slip relative to one another when the torque capacity of the overload clutch is exceeded. The overload clutch disclosed in Bopp however, requires large number of components and is very complicated and difficult to manufacture and assemble. As a result, the overload clutch disclosed in Bopp is also expensive and does not provide an economically practical overload clutch.

U.S. Pat. No. 5,791,579 to Raphael et al. discloses another overload prevention clutch assembly which includes a resiliently deformable coupling member which is controlled by a threaded fastener to thereby vary the torque which may be transmitted between the lever and the hoist. While requiring less components than the clutch of Bopp, the overload prevention clutch assembly of Raphael et al. however, is also relatively complicated and is difficult to manufacture and assemble. As a result, the overload prevention clutch assembly disclosed in Raphael et al. is also expensive and does not provide an economically practical overload prevention assembly.

U.S. Pat. No. 4,768,754 to Nishimura discloses yet another overload preventor for use with a manual hoist which includes a drive gear with teeth around its periphery, a force exerting member, and a conical friction ring disposed therein between for frictionally engaging the drive gear with the force exerting member. The torque capacity of the overload preventor is determined by the pressing force exerted on the conical friction ring and is adjusted by a nut threaded on to the force exerting member. To ensure proper engagement between the conical friction ring and the force exerting member, the overload preventor disclosed in Nishimura requires that the conical friction ring be provided with projections which engage recesses of the force exerting member. Such required provisions are difficult to manufacture add to the component manufacturing costs, thereby increase the cost of the overload preventor. Moreover, to ensure proper pressing force, the overload preventor disclosed in Nishimura requires various washers and fasteners. Such additional components further increase the cost of the overload preventor and also increases the cost associated with assembling such additional components.

Therefore, in view of the above noted deficiencies of the prior art devices, there exists an unfulfilled need for a simple overload protection device for a lever hoist which minimizes the number of components required and the complexity of such components to thereby minimize the associated component costs. In addition, an unfulfilled need still exists for such an improved overload protection device which is easy to assemble so as to minimize assembly costs.

BRIEF SUMMARY OF THE INVENTION

In view of the foregoing, it is an object of the present invention to provide an improved overload protection device for a lever of a manual lever hoist which minimizes number and the complexity of the components required.

A second object of the present invention is to provide such an improved overload protection device which is easy to manufacture and assemble.

A third object of the present invention is to provide such an improved overload protection device which can be adjusted for use in various manual lever hoist applications.

Yet another object of the present invention is to provide an improved overload protection device which is economical.

In accordance with one preferred embodiment of the present invention, these objects are obtained by an improved overload protection device for a manual hoist lever including a pressure hub, an outer hub, a brake nut, and a dowel pin. In accordance with the preferred embodiments, the pressure hub includes a radially extending flange and a substantially centrally positioned cantilevered boss, the boss having a threaded outer surface with an axial groove extending from an end of the boss toward the radially extending flange. The outer hub includes a central opening, a tapered inner surface, and a flange contact surface which frictionally contacts the radially extending flange of the pressure hub. The brake nut is disposed in the central opening of the outer hub between the outer hub and the boss of the pressure hub. The brake nut also includes a frusto-conical outer surface that frictionally contacts the tapered inner surface of the outer hub and a threaded inner opening with a corresponding axial groove, the threaded inner opening being sized to threadingly engage the threaded outer surface of the boss. The dowel pin is received within a receiving hole formed upon alignment of the axial groove of the boss and the corresponding axial groove of the brake nut, thereby locking the pressure hub and the brake nut together to prevent relative rotation thereof. In this regard, the axial groove of the pressure hub and the corresponding axial groove of the brake nut are preferably semi-circular so that a circular hole is formed upon alignment of the axial groove and the corresponding axial groove, and a cylindrical dowel pin is received therein.

In the preferred embodiment of the overload protection device in accordance with the present invention, the pressure hub is adapted to be attached to a hoist and the outer hub is adapted to be engaged by a lever for operating the hoist. The outer hub preferably includes a plurality of ratchet gear teeth positioned on an outer surface of the outer hub, the plurality of ratchet gear teeth being adapted to be engaged by a tapered rod end or a ratchet pawl of the lever. The pressure hub preferably also includes a threaded attachment hole extending through the boss for receiving a threaded end of a pinion shaft of the hoist. The outer hub is rotatable relative to the pressure hub and the brake nut during an overload condition which occurs when a relative rotational force overcomes frictional resistance of the overload protection device. The frictional resistance is caused by frictional contact between the flange contact surface of the outer hub and the radially extending flange of the pressure hub, and also by the frictional contact between the tapered inner surface of the outer hub and the frusto-conical outer surface of the brake nut. In this regard, in the preferred embodiment, the radially extending flange extends substantially normal to the boss, and the flange contact surface of the outer hub flushly contacts the radially extend flange to thereby generate frictional resistance to relative rotation between the pressure hub and the outer hub. In addition, the tapered inner surface of the outer hub flushly contacts the frusto-conical outer surface of the brake nut to thereby generate frictional resistance to relative rotation between the outer hub and the brake nut.

The frictional resistance of the overload protection device is at least partially determined by the axial positioning of the brake nut relative to the radially extending flange and is preferably adjustable by tightening or loosening the brake nut. For instance, in one embodiment, the tightening of the brake nut increases the frictional resistance of the overload protection device while loosening the brake nut decreases the frictional resistance of the overload protection device. In this regard, the brake nut preferably includes an engagement opening adapted to allow receipt of a tool for threadingly engaging and adjusting the brake nut on the threaded outer surface of the boss. The engagement opening preferably has a hexagonal shape or a rectangular shape. In addition, to assist in the assembly of the overload protection device, the radially extending flange of the pressure hub may also include a plurality of locating holes.

In another embodiment of the overload protection device, the outer hub is adapted to be attached to a hoist and at least one of the pressure hub and the brake nut is adapted to be engaged by a lever. In such an embodiment, the pressure hub includes a plurality of ratchet gear teeth positioned on a peripheral edge surface of the radially extending flange, the plurality of ratchet gear teeth being adapted to engage a tapered rod end or a ratchet pawl of the lever.

These and other objects, features and advantages of the present invention will become more apparent from the following detailed description of the preferred embodiments of the invention when viewed in conjunction with the accompanying drawings.

DETAILED DESCRIPTION OF THE INVENTION

Figure 1A:
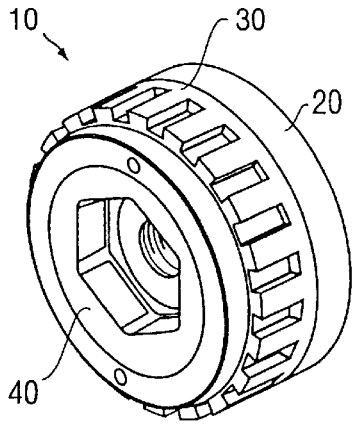
FIG. 1A is a perspective view of an improved overload protection device in accordance with one embodiment of the present invention which can be used in a manual lever hoist.
Figure 3:
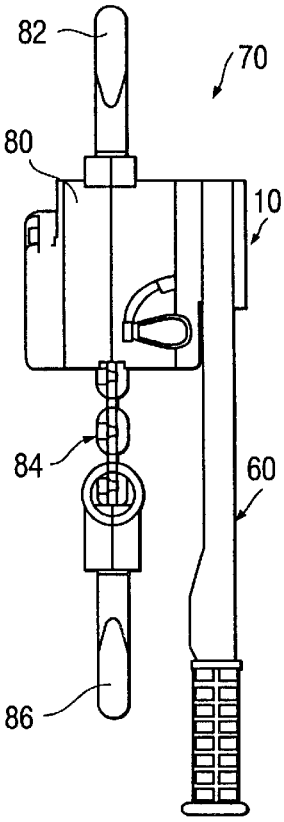
FIG. 3 is a side profile view of the lever attached to and engaging a hoist.

FIG. 1A illustrates a perspective view of the overload protection device 10 in accordance with the preferred embodiment of the present invention which may be used in a lever of a manual lever hoist as shown in FIG. 3. As will be described herein below, the overload protection device 10 avoids the disadvantages of the prior art devices by minimizing the number and the complexity of the components required. Furthermore, the present invention also provides such an improved overload protection device 10 which is easy to manufacture and assemble and can be adjusted for use in various manual lever hoist applications. Thus, it will be evident how the present invention provides a very economical and practical overload protection device 10.

Figure 1B:
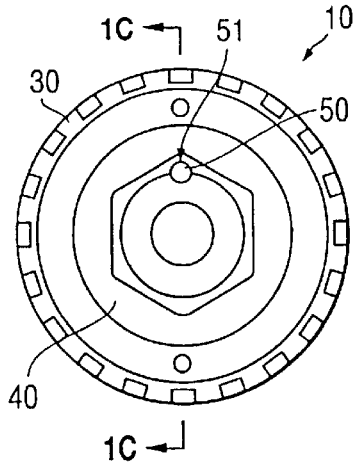
FIG. 1B is a frontal view of the overload protection device of FIG. 1A.
Figure 1C:
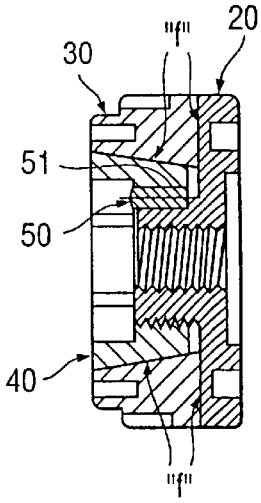
FIG. 1C is a cross-sectional view of the overload protection device of FIG. 1B as viewed along 1*c*—1*c*.
Figure 2:
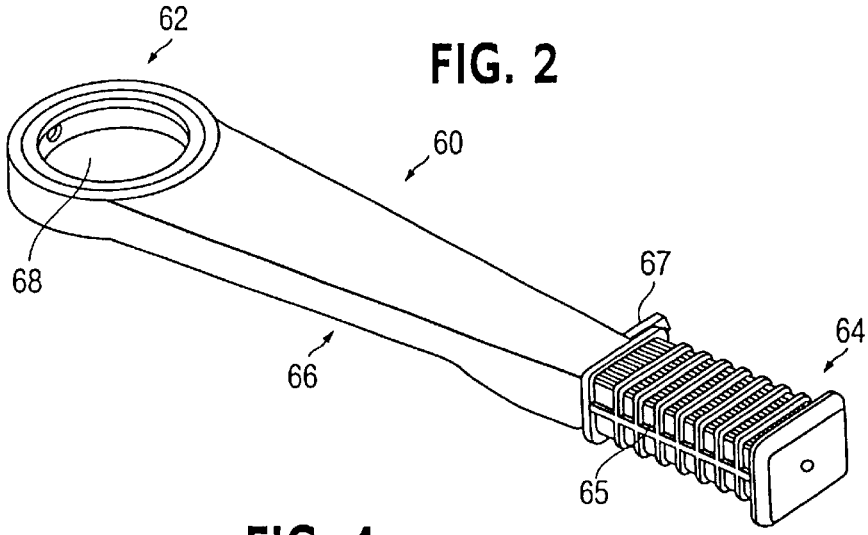
FIG. 2 is a perspective view of a lever in which the overload protection device of the present invention may be used.

FIGS. 1A to 1C illustrates various assembly views of the overload protection device 10 in accordance with the preferred embodiment of the present invention. As can be seen in these figures, the overload protection device 10 includes a pressure hub 20, an outer hub 30, a brake nut 40, and a dowel pin 50, the details of which are discussed in further detail herein below. These components of the overload protection device 10 are assembled in the manner most clearly shown in the cross-sectional view of FIG. 1C to provide a simple overload protection device 10 that is easy to manufacture and assemble thereby minimizing costs. The overload protection device 10 is designed to be installed into a lever 60 of the type shown in FIG. 2 which in turn, is adapted to engage a hoist 80 of the type illustrated in FIG. 3 to thereby provide a manual lever hoist assembly 70 that can be used to lift and/or lower heavy objects. As can be seen in FIG. 2, the lever 60 includes a distal end 62, a proximal end 64 and a midsection 66 spanning therein between. The distal end 62 includes an opening 68 which is adapted to receive the overload protection device 10 in accordance with the present invention. The overload protection device 10 is received in the opening 68 in a manner known in the art to thereby allow the lever 60 to operate the hoist 80 of FIG. 3. As can also be clearly seen in FIG. 2, a handle grip sleeve 65 is provided toward the proximal end 68 of the lever 60 to thereby enhance grip of the user. In addition, a trigger 67 is provided proximate to the grip sleeve 65 to allow operation of the overload protection device in the manner also known in the art. More specifically, the trigger 67 may be adapted to actuate a tapered rod end or a ratchet pawl (not shown) of the lever 60 in the manner known in the art to engage or disengage the overload protection device 10 in accordance with the present invention. In this regard, the tapered rod end or a ratchet pawl (not shown) engages a component of the overload protection device 10 in the manner described in further detail herein below to thereby allow lifting and/or lowering of an object by repeated transverse movement of the lever 60, i.e. by ratcheting operation of the lever.

FIG. 3 generally illustrates how the overload protection device 10 in accordance with the present invention will be typically used. As previously noted, the overload protection device 10 is received in the opening 68 at the distal end of the lever 60 of the type shown in FIG. 2 and discussed above. The lever 60 is engaged to the hoist 80 to thereby provide a manual lever hoist assembly 70 which is operable to lift and/or lower an object. The lever 60 is engaged to the hoist 80 via the overload protection device 10 and a pinion shaft (not shown) of the hoist 80 which is known in the art and exemplified in the prior art references discussed previously. The manual lever hoist assembly 70 may be suspended using the upper hook 82 which may be attached to a beam (not shown) or other structural member such as a rail trolley (not shown). The hoist 80 is actuable via the lever 60 to displace a chain 84 with a lower hook 86 attached thereto which may be secured to or otherwise attached to the object to be lifted and/or lowered thereby providing a material handling equipment suitable for handling heavy objects which are difficult to handle manually. The details of the hoist 80 and the lever 60 are generally well known in the art and need not be discussed in further detailed herein.

Figure 4:
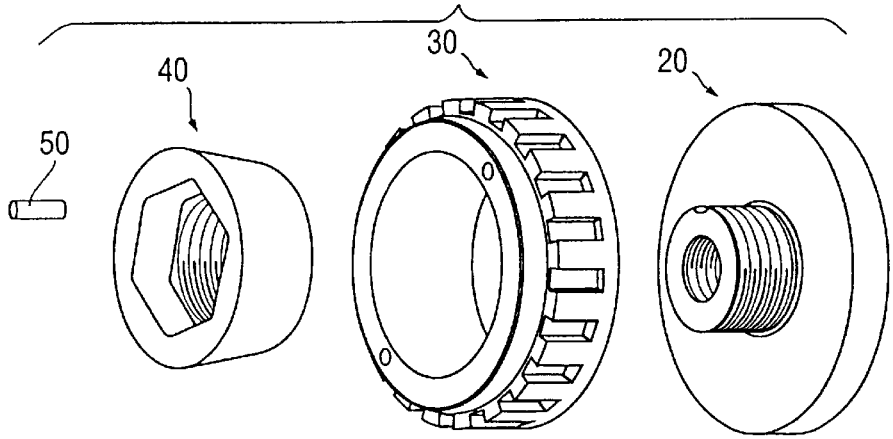
FIG. 4 is an exploded perspective view of the overload protection device of FIG. 1A clearly showing the various components.

FIG. 4, shows an exploded perspective view of the overload protection device 10 of FIG. 1A clearly showing the pressure hub 20, the outer hub 30, the brake nut 40, and the dowel pin 50 in accordance with the preferred embodiment of the present invention. The pressure hub 20, the outer hub 30, and the brake nut 40 are discussed in further detail herein below with reference to FIGS. 5A to 7B which show various detailed views of these components. These components are assembled in the manner most clearly shown in the cross-sectional view of FIG. 1C to thereby provide a very simple and economical overload protection device 10 which can be used to limit the amount of torque which may be applied to the hoist 80 via the lever 60, the operation of the overload protection device 10 also being set forth herein below.

Figure 5A:
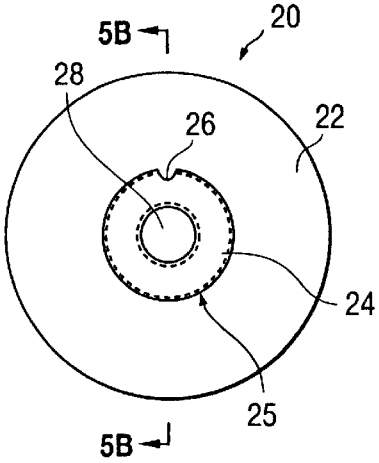
FIG. 5A is a frontal view of the pressure hub in accordance with one embodiment of the present invention.
Figure 5B:
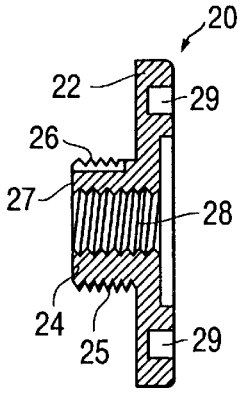
FIG. 5B is a cross-sectional view of the pressure hub of FIG. 5A as viewed along 5*b*—5*b*.
Figure 5C:
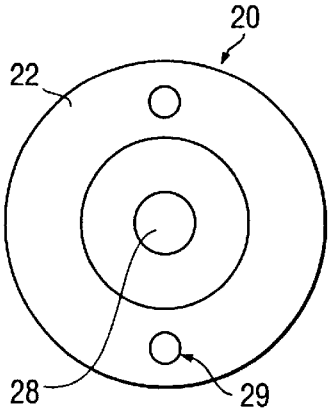
FIG. 5C is a rear view of the pressure hub of FIG. 5A.

As can be clearly seen in FIGS. 5A to 5C, the pressure hub 20 in accordance with the illustrated embodiment includes a radially extending flange 22 and a substantially centrally positioned cantilevered boss 24. The boss 24 has a threaded outer surface 25 with an axial groove 26 extending from an end 27 of the boss 24 toward the radially extending flange 22. In the preferred embodiment, the pressure hub 20 also includes a threaded attachment hole 28 extending through the boss 24 for receiving a threaded end of a pinion shaft (not shown) of the hoist 80 to allow engagement and attachment of the lever 60 to the hoist 80. In the illustrated embodiment, the radially extending flange 22 of the pressure hub 20 may also include a plurality of locating holes 29 which may be used to assist in the assembly of the overload protection device 10.

Figure 6A:
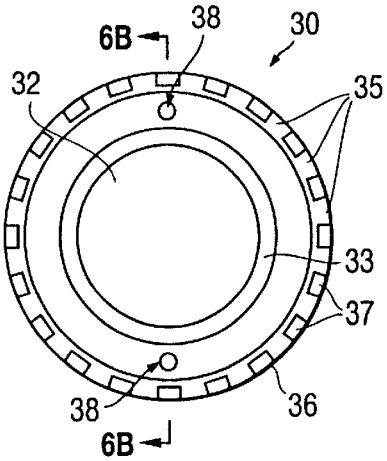
FIG. 6A is a frontal view of a ratchet gear hub in accordance with one embodiment of the present invention.
Figure 6B:
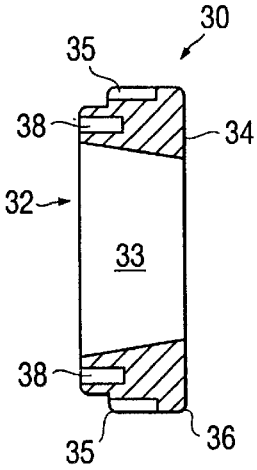
FIG. 6B is a cross-sectional view of the ratchet gear hub of FIG. 6A as viewed along 6*b*—6*b*.

FIGS. 6A and 6B clearly illustrate the features of the outer hub 30 in accordance with the illustrated embodiment, the outer hub 30 including a central opening 32, a tapered inner surface 33, and a flange contact surface 34 which frictionally contacts the radially extending flange 22 of the pressure hub 20. In the present embodiment, the outer hub 30 is adapted to be engaged by the lever 60 and preferably includes a plurality of ratchet gear teeth 35 positioned on an outer surface 36 of the outer hub 30. As can be clearly seen, the ratchet gear teeth 35 of the present embodiment are formed by grooves 37 along the outer surface 36 of the outer hub 30. However, other types of gear teeth may be provided instead. In addition, as can be appreciated by one skilled in the art and as briefly noted previously, the plurality of ratchet gear teeth 35 are adapted to be engaged by the tapered rod end or the ratchet pawl (not shown) of the lever 60 to allow lifting and/or lowering of an object by repeated transverse movement of the lever 60. Thus, the ratchet gear teeth 35 along the outer surface 36 of the outer hub 30 together with the tapered rod end or the ratchet pawl (not shown) of the lever provide a ratchet mechanism for ratcheting operation of the lever 60. Furthermore, the outer hub 30 may also be provided with mounting holes 38 which may be used to mount a retaining plate (not shown) to keep dirt and other contaminants out of the overload protection device 10.

Figure 7A:
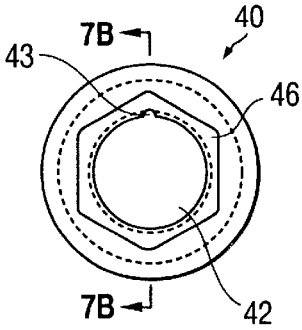
FIG. 7A is a frontal view of the brake nut in accordance with one embodiment of the present invention.
Figure 7B:
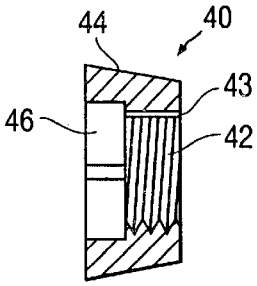
FIG. 7B is a cross-sectional view of the brake nut of FIG. 7A as viewed along 7*b*—7*b*.

Finally, as can be clearly seen in FIGS. 7A and 7B, the brake nut 40 includes a threaded inner opening 42 which is sized to threadingly engage the threaded outer surface 25 of the boss 24 of the pressure hub 20. The brake nut 40 also includes a frusto-conical outer surface 44 that frictionally contacts the tapered inner surface 33 of the outer hub 30. In addition, the brake nut 40 also includes a corresponding axial groove 43 which, together with the axial groove 26 of the boss 24, form a receiving hole described herein below for receiving the dowel pin 50 shown in FIG. 4. Moreover, in the preferred embodiment shown, the brake nut 40 also preferably includes an engagement opening 46 which is adapted to allow receipt of a tool (not shown) for threadingly engaging and adjusting the brake nut 40 on the threaded outer surface 25 of the pressure hub 20. The engagement opening 46 may have any appropriate shape which corresponds to the shape of the tool but as can be seen, the engagement opening 46 in the illustrated embodiment has a hexagonal shape.

Referring again to the cross-sectional view of FIG. 1C, the brake nut 40 is disposed in the central opening 32 of the outer hub 30 between the outer hub 30 and the boss 24 of the pressure hub 20. The threaded inner opening 42 of the brake nut 40 is threadingly engaged to the threaded outer surface 25 of the boss 24 of the pressure hub 20. The brake nut 40 is threaded to a desired position (as described in further detail herein below) and rotated to align the axial groove 26 of the boss 24 and the corresponding axial groove 43 of the brake nut 40. Upon alignment of the axial groove 26 of the boss 24 and the corresponding axial groove 43 of the brake nut 40, a receiving hole 51 is formed by the grooves as shown in FIGS. 1B and 1C. The dowel pin 50 shown in FIG. 4 is received within the receiving hole 51 and thus, locks the pressure hub 20 and the brake nut 40 together to prevent relative rotation thereof. In this regard, in the preferred embodiment, the axial groove 26 of the pressure hub 20 and the corresponding axial groove 43 of the brake nut 40 are preferably semi-circular so that the receiving hole formed is circular and the dowel pin 50 received therein is cylindrical with a circular cross-section sized to fit within the formed receiving hole 51.

As previously noted, the overload protection device 10 in accordance with the preferred embodiment of the present invention as described above can be used to limit the amount of torque that may be applied to the hoist 80 via the lever 60. When the overload protection device 10 is used, overloading of the hoist, chain, and/or any other component such as the hook attached to the chain or the structure supporting the hoist can be prevented so that component failure, damage to the object being lifted, or bodily harm to the operator can be avoided. In particular, during an overload condition, the outer hub 30 is rotatable relative to the pressure hub 20 and the brake nut 40 which have been locked together by the dowel pin 50. The overload condition occurs when a relative rotational force tending to cause relative rotation between the outer hub 30 and the locked pressure hub 20/brake nut 40 overcomes the frictional resistance of the overload protection device 10. In the present illustrated embodiment of FIG. 1C, this frictional resistance is partially caused by the frictional contact between the flange contact surface 34 of the outer hub 30 and the radially extending flange 22 of the pressure hub 22. The frictional resistance is also partially caused by the frictional contact between the tapered inner surface 33 of the outer hub and the frusto-conical outer surface 44 of the brake nut 40. These frictional interfaces of the various components are indicated by "f" in FIG. 1C. It should also be noted that in order to increase torque transmission capacity while maintaining reliable performance of the overload protection device 10, the radially extending flange 22 extends substantially normal to the boss 24, and the flange contact surface 34 of the outer hub 30 flushly contacts the radially extend flange 22. In addition, the tapered inner surface 33 of the outer hub 30 flushly contacts the frusto-conical outer surface 44 of the brake nut 40.

As can be appreciated by one skilled in the art and by examination of FIG. 1C, this frictional resistance of the overload protection device 10 is determined by the axial positioning of the brake nut 40 relative to the radially extending flange 22. In addition, this frictional resistance is adjustable by tightening or loosening the brake nut 40 along the boss 24 of the pressure hub 20. Due to the frusto-conical outer surface 44 of the brake nut 40, as the brake nut 40 is tightened so that it is positioned closer to the radially extending flange 22 of the pressure hub 20, the contact pressure in the interface between the frusto-conical outer surface 44 of the brake nut 40 and the tapered inner surface 33 is increased thereby increasing the frictional resistance at this interface. In addition, also due to the frusto-conical outer surface 44 of the brake nut 40, tightening of the brake nut 40 also causes the outer hub 30 to be pressed against the radially extending flange 22 at an increased pressure thereby also increasing the frictional resistance at this interface as well. Thus, in the illustrated embodiment, the tightening of the brake nut 40 causes the brake nut 40 to be wedged in tighter between the boss 24 and the outer hub 30 and increases the frictional resistance of the overload protection device 10 along the frictional interfaces "f". Conversely, as can now be easily appreciated, loosening the brake nut 40 decreases the frictional resistance of the overload protection device 10 along the frictional interfaces "f".

Therefore, in view of the above, it should also be evident that the overload protection device 10 in accordance with the present invention may be used in various manual lever hoist applications where the desired torque limit applied via the lever 60 also varies depending on the application. For instance, the present overload protection device 10 can be utilized in a light duty hoists as well as in medium and heavier duty hoists merely by tightening the brake nut 40 to obtain the desired torque limit. This allows the manufacturer of the overload protection device 10 to minimize costs since one device can be used for various torque ranges. Moreover, the torque limit can also be adjusted by removing the dowel pin 50, tightening or loosening the brake nut 40, and reinserting the torque nut 40. In this regard, the dowel pin 50 may be made to be removable and additional axial grooves may be provided on the boss 24 and the brake nut 40 to allow finer adjustment of the torque limit. For instance, axial grooves may be provided every 90° along the boss 24 and the brake nut 40 to allow more incremental adjustment of the torque limit of the overload protection device 10.

Alternatively, the present invention can also be practiced so that the overload protection device 10 is not adjustable by the end user/operator. For instance, the torque limit of the overload protection device 10 may be "set" by the manufacturer at the desired torque limit and the dowel pin 50 fixed within the receiving hole 51 so that the brake nut 40 cannot be tightened or loosened by the end user/operator. Preferably, this can be readily attained by drilling the receiving hole 51 subsequent to threading the brake nut 40 on to the boss 24 of the pressure hub 20 to the desired torque limit, and inserting a dowel pin 50 which has a slight interference fit with the receiving hole 51. Because the drilling of the receiving hole 51 occurs subsequent to threading the brake nut 40 on to the boss 24, the threads of the threaded outer surface 25 of the boss 24 as well as the threaded inner opening 42 of the brake nut 40 will be slightly deformed thereby preventing further rotation of the brake nut 40. In addition, because the dowel pin 50 is installed into the receiving hole 51 with a slight interference fit, the dowel pin 50 cannot be easily removed. In this manner, once the receiving hole 51 is drilled into the brake nut 40 and the boss 24 of the pressure hub 20 and the dowel pin 50 is installed, further adjustment by the end user/operator is prevented. Furthermore, by drilling the receiving hole 51 subsequent to threading the brake nut 40 on to the boss 24 in one single step, the manufacturing costs of the overload protection device 10 can be reduced. Again, it should be noted however, that the initial adjustability of the overload protection device 10 prior to drilling of the receiving hole 51 and insertion of the dowel pin 50 allows the manufacturer to further minimize costs since one device can be used for various torque ranges thereby providing a very significant benefit to the manufacturer of the overload protection device 10 and/or lever 60 which uses such a device in accordance with the present invention.

From the foregoing, it should now be apparent how the present invention provides an improved overload protection device for a lever hoist which minimizes number and the complexity of the components required. In addition, it can be also seen how the present invention provides such an improved overload protection device which is easy to manufacture and assemble. Furthermore, it can be seen how the present invention provides such an improved overload protection device which can be adjusted for use in various manual lever hoist applications. Moreover, it can now also be seen how the present invention provides an improved overload protection device which is very economical.

While various embodiments in accordance with the present invention have been shown and described, it is understood that the invention is not limited thereto. These embodiments may be changed, modified and further applied by those skilled in the art. For instance, in another embodiment of the overload protection-device in accordance with the present invention, the outer hub may be adapted to be attached to the hoist while the pressure hub and/or the brake nut is adapted to be engaged by the lever. In such an embodiment, the pressure hub would include a plurality of ratchet gear teeth positioned on a peripheral edge surface of the radially extending flange, the plurality of ratchet gear teeth being adapted to engage a tapered rod end or a ratchet pawl of the lever. Although such an embodiment may be used, the illustrated embodiment discussed above is more desirable since it will ensure a simple and economical overload protection device with the advantages discussed above. Correspondingly, this invention is not limited to the details shown and described previously but also includes all such changes and modifications which are encompassed by the appended claims.

What is claimed is:

1. An overload protection device for a manual hoist lever comprising:

a pressure hub with a radially extending flange and a substantially centrally positioned cantilevered boss, said boss having a threaded outer surface with an axial groove extending from an end of said boss toward said radially extending flange;

an outer hub with a central opening, said outer hub including a tapered inner surface, and a flange contact surface which frictionally contacts said radially extending flange of said pressure hub;

a brake nut disposed in said central opening of said outer hub between said outer hub and said boss of said pressure hub, said brake nut having a frusto-conical outer surface that frictionally contacts said tapered inner surface of said outer hub, and a threaded inner opening with a corresponding axial groove, said threaded inner opening being sized to threadingly engage said threaded outer surface of said boss; and a dowel pin received within a receiving hole formed upon alignment of said axial groove of said boss and said corresponding axial groove of said brake nut, thereby locking said pressure hub and said brake nut together to prevent relative rotation thereof.

2. The overload protection device of claim 1, wherein said pressure hub is adapted to be attached to a hoist and said outer hub is adapted to be engaged by said lever.

3. The overload protection device of claim 2, wherein said outer hub includes a plurality of ratchet gear teeth positioned on an outer surface of said outer hub, said plurality of ratchet gear teeth being adapted to be engaged by at least one of a tapered rod end and a ratchet pawl of said lever.

4. The overload protection device of claim 3, wherein said pressure hub includes an attachment hole extending into said boss for receiving a pinion shaft of said hoist.

5. The overload protection device of claim 4, wherein said attachment hole is a threaded through hole for receiving a threaded end of said pinion shaft.

6. The overload protection device of claim 1, wherein said outer hub is adapted to be attached to a hoist and at least one of said pressure hub and said brake nut is adapted to be engaged by said lever.

7. The overload protection device of claim 6, wherein said pressure hub includes a plurality of ratchet gear teeth positioned on a peripheral edge surface of said radially extending flange, said plurality of ratchet gear teeth being adapted to engage at least one of a tapered rod end and a ratchet pawl of said lever.

8. The overload protection device of claim 1, wherein said radially extending flange of said pressure hub includes a plurality of locating holes for assisting assembly of said overload protection device.

9. The overload protection device of claim 1, wherein said radially extending flange extends substantially normal to said boss, and said flange contact surface of said outer hub flushly contacts said radially extend flange to thereby generate frictional resistance to relative rotation between said pressure hub and said outer hub.

10. The overload protection device of claim 1, wherein said tapered inner surface of said outer hub flushly contacts said frusto-conical outer surface of said brake nut to thereby generate frictional resistance to relative rotation between said outer hub and said brake nut.

11. The overload protection device of claim 1, wherein said brake nut includes an engagement opening adapted to allow receipt of a tool for threadingly engaging said brake nut to said threaded outer surface of said boss.

12. The overload protection device of claim 11, wherein said engagement opening is at least one of hexagonal and rectangular in shape.

13. The overload protection device of claim 1, wherein said axial groove of said pressure hub and said corresponding axial groove of said brake nut are semi-circular in shape so that a circular hole is formed upon alignment of said axial groove and said corresponding axial groove.

14. The overload protection device of claim 13, wherein said dowel pin is cylindrical.

15. The overload protection device of claim 1, wherein said outer hub is rotatable relative to said pressure hub and said brake nut during an overload condition, said overload condition occurring when a relative rotational force overcomes frictional resistance of said overload protection device caused by frictional contact between said flange contact surface of said outer hub and said radially extending flange of said pressure hub, and by frictional contact between said tapered inner surface of said outer hub and said frusto-conical outer surface of said brake nut.

16. The overload protection device of claim 15, wherein said frictional resistance of said overload protection device is at least partially determined by axial positioning of said brake nut relative to said radially extending flange.

17. The overload protection device of claim 16, wherein said frictional resistance of said overload protection device is adjustable by at least one of tightening and loosening said brake nut.

18. The overload protection device of claim 17, wherein tightening of said brake nut increases said frictional resistance of said overload protection device and loosening said brake nut decreases said frictional resistance of said overload protection device.

19. The overload protection device of claim 18, wherein said outer hub includes a plurality of ratchet gear teeth positioned on an outer surface of said outer hub, said plurality of ratchet gear teeth being adapted to be engaged by at least one of a tapered rod end and a ratchet pawl of said lever.

20. The overload protection device of claim 19, wherein said pressure hub is adapted to be attached to a hoist and includes a threaded attachment hole extending through said boss for receiving a threaded end of a pinion shaft of said hoist.

21. The overload protection device of claim 19, wherein said brake nut includes an engagement opening adapted to allow receipt of a tool for threadingly engaging said brake nut to said threaded outer surface of said boss, said engagement opening having at least one of a hexagonal shape and a rectangular shape.

22. The overload protection device of claim 19, wherein said axial groove of said pressure hub and said corresponding axial groove of said brake nut are semi-circular so that a circular hole is formed upon alignment of said axial groove and said corresponding axial groove.

23. The overload protection device of claim 22, wherein said dowel pin is cylindrical.

* * * * *